United States Patent [19]

Dietz

[11] 4,141,357

[45] Feb. 27, 1979

[54] CUP SUPPORTER FOR INSERTION INTO A GARMENT

[76] Inventor: Henry G. Dietz, 80 Salisbury Ave., Garden City, N.Y. 11530

[21] Appl. No.: 858,393

[22] Filed: Dec. 6, 1977

Related U.S. Application Data

[63] Continuation of Ser. No. 748,125, Dec. 6, 1976, abandoned.

[51] Int. Cl.[2] ..... A61F 5/40

[52] U.S. Cl. ..... 128/159

[58] Field of Search ..... 128/158, 159, 160, 161

[56] References Cited

U.S. PATENT DOCUMENTS

| | | | |
|---|---|---|---|
| 908,533 | 1/1909 | Zuckeriegel | 128/158 |
| 1,615,192 | 1/1927 | Pelton | 128/159 |
| 1,641,094 | 8/1927 | Peterkin | 128/158 |
| 2,058,970 | 10/1936 | Flesh | 128/159 |
| 2,674,244 | 4/1954 | Brodick | 128/158 X |

FOREIGN PATENT DOCUMENTS

| | | | |
|---|---|---|---|
| 77639 | 12/1893 | Fed. Rep. of Germany | 128/161 |

*Primary Examiner*—John D. Yasko

[57] ABSTRACT

A cup supporter with a spherical shaped pouch. An elastic strap fastened to said spherical shaped pouch provides two attachment straps. Attachment straps are passed through buckles to provide adjustment and fastening of loops or hooks to ends of the attachment strap. The cup supporter is inserted into a garment permanently by use of the attachment strap's loops. Alternate non-permanent insertion is by use of the attachment strap's hooks being fastened to loops attached to the garment. The spherical pouch supports the male vital parts.

7 Claims, 8 Drawing Figures

CUP SUPPORTER FOR INSERTION INTO A GARMENT

This is a continuation of application Ser. No. 748,125 filed Dec. 6, 1976, now abandoned.

SUMMARY OF THE INVENTION

This invention relates to supporters and more particularly to one that has a spherical pouch with adjustable attachment straps to allow insertion into a garment.

Supporters are generally considered to be a separate device worn to give support and protection to the male vital parts.

Supporters are worn by many males under bathing suits and like garments as the linings provided in such garments are of such light weight materials as to give unsatisfactory support and little or no protection against impact.

Males engaged in non-contact sports, such as swimming, wear separate supporters to overcome the above mentioned shortcomings and also to prevent embarrassment by holding the male vital parts in proper place within the garment.

Separate supporters are clumsy devices having a waist band and leg straps that deform the shape of the male body when being worn.

Often the leg straps and waist band are accidently visible outside areas not covered by a garment.

Separate supporters often fail to give adequate support as support can only be obtained by actual uplifting of the male vital parts. Most present day supporters hold the said male vital parts in place close to the body between the legs and this causes chafing and a lack of freedom from friction due to leg movements.

A cup supporter with removable elastic hip band overcomes many of these objections and for further details concerning how these objections are overcome see co-pending application No. 723,451 group No. 353, filed Sept. 15, 1976, and assigned to the assignee of this application.

The principal object of the present invention is to improve on the above mentioned supporters by elimination of the waist band or hip band, or the leg straps by inserting the supporter directly into a garment and eliminating the need of wearing a separate device for support and protection from injury.

Another object of this invention is to provide a supporter that is fully adjustable to provide the necessary uplift for proper support and prevention of leg chafe.

Another object of this invention is to provide a supporter that can be manufactured in a single size, but which is adjustable so it can be inserted into any garment to fit any size male.

Another object of this invention is to make it unnecessary to provide a lining in garments, such as bathing suits, when the supporter is inserted into the garment.

Another object of this invention is that any existing garment, such as a bathing suit, can be easily modified with little effort to accept the insertion of this supporter.

Another object of this invention is that the purchaser of a garment can have the option of buying a garment with or without the inserted supporter. A single supporter can be worn in a number of garments.

Another object of this invention is that this supporter can be inserted into brief light weight competition type speed bathing suits that normally are provided with linings that do not give the desired support or protection from light impact injuries.

Another object of this invention is that the adjustable straps are located in the crevices formed by the lower abdomen and legs and prevent their showing through the garment. This combined with the soft spherical shape of the supporter creates a more pleasing appearance.

And, still another object of this invention is that the supporter be inexpensive to manufacture and yet provide comfort, support, and protection from light impact forces.

BRIEF DESCRIPTION OF THE DRAWINGS

Other features and advantages of the cup supporter for insertion into a garment, in accordance with the present invention, will be better understood as described in the following specification and appended claims in connection with the following drawings in which:

DESCRIPTION OF THE PREFERRED EMBODIMENTS

In accordance with the drawings, the cup supporter for insertion into a garment comprises soft pliable material cut into the non-circular shapes of two patterns 1,2. The two non-circular shapes are sewn together along the curved edges to form a spherical shaped pouch 3. Other methods of forming the spherical shaped pouch 3, such as molding suitable flexible material may be used in place of the one described.

Figure 1:
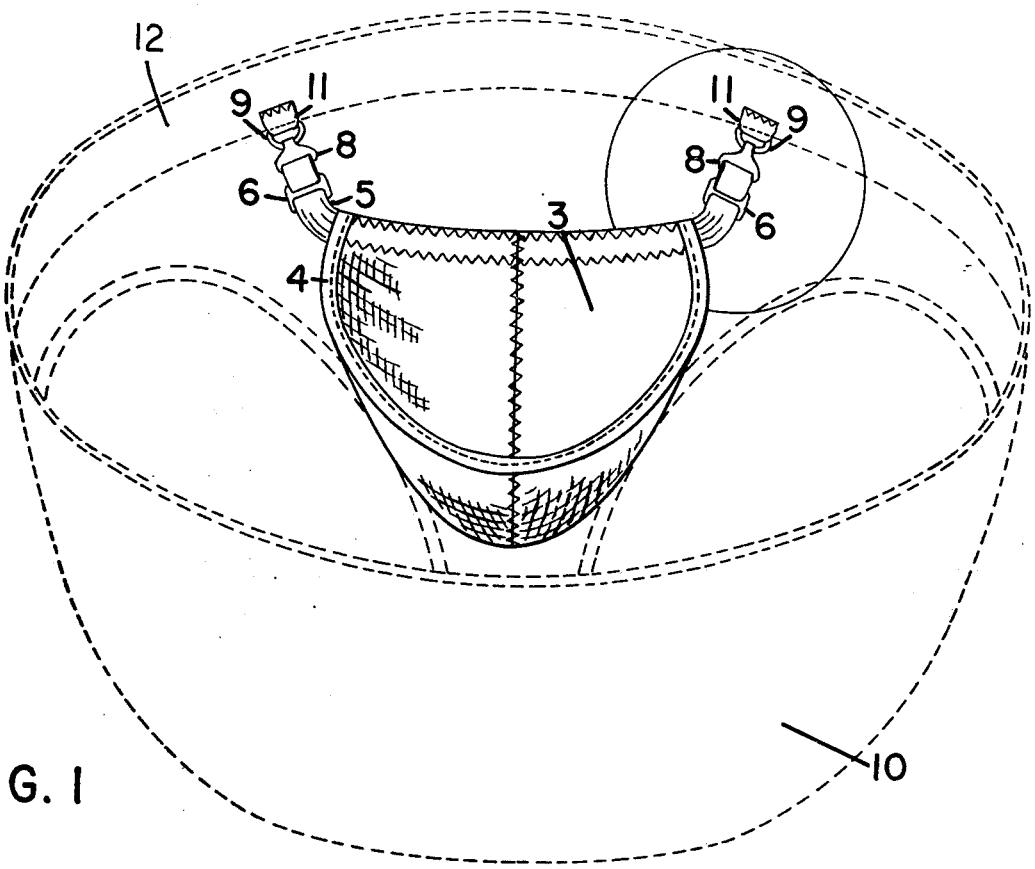
FIG. 1 is a rear view looking down into a garment, such as a brief bathing suit showing the inserted cup supporter.
Figure 2:
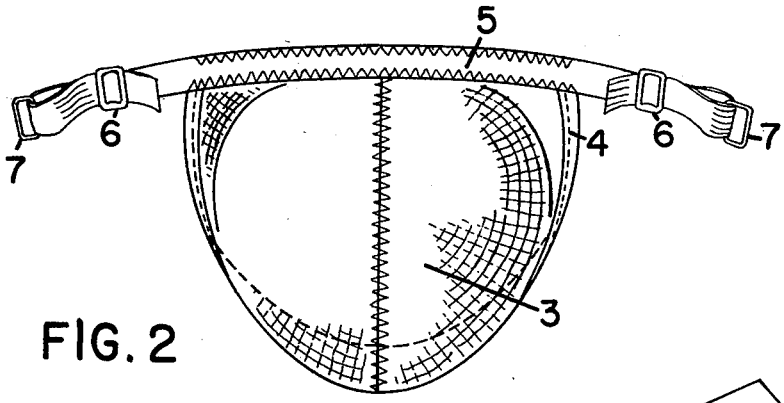
FIG. 2 is a front view of the cup supporter.
Figure 3:
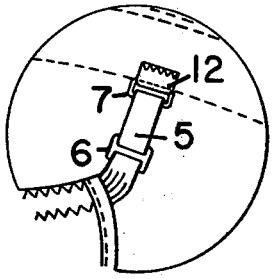
FIG. 3 is a rear view, in section, taken on circle section A of FIG. 1.
Figure 4:
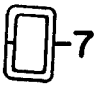
FIG. 4 is a view of loop used in FIG. 3.
Figure 6:
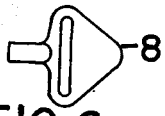
FIG. 6 is a view of hook used in FIG. 1.
Figure 5:
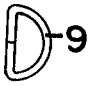
FIG. 5 is a view of half circular loop used in FIG. 1.
Figure 7:
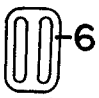
FIG. 7 is a view of buckle used for making attachment straps adjustable.
Figure 8:
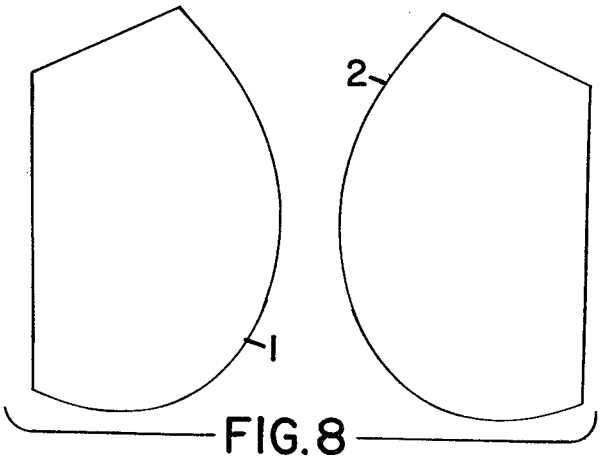
FIG. 8 are patterns of the non-circular shapes used to form the spherical pouch.

A bias tape 4 may be sewn to the sides and bottom edges of the spherical shaped pouch 3. An elastic strap 5 is secured to the top of the spherical shaped pouch having its ends extending outwardly. The elastic strap ends are passed through buckles 6 and through hooks 8, or through loops 7 and back through the buckles 6. The garment 10 is normally provided with one or more of the following: an elastic band encircling the top edge, a cord passing through a rolled over top seam encircling the top edge of the garment 10 with the ends of the cord tied together, or a belt encircling the top of the garment 10 held in place with belt loops. The fastening of the half circle loops 9 with sewn tapes 11, or the fastening of the loops 7 with sewn tapes 12 on the belt line 12 allows the garment 10 to have the same function as the waist strap or hip strap of the supporter worn as a separate device. The garment 10 also serves to function as the leg straps of the supporter worn as a separate device by holding the spherical shaped pouch 3 in correct position with relation to the male body. The spherical shaped pouch 3 provides support by uplifting the male vital parts contained therein. The amount of length and tension of the elastic strap 5, is adjusted to suit the comfort of the wearer. The cup supporter can be removed if desired by removing the hooks 8 from the half round loops 9. To install the cup supporter permanently in the garment, the loop 7 is used in place of the hook 8 as shown in section A, FIG. 3, taken on circle section A of FIG. 1. The loop 7 is fastened with the tape 12 to the belt section of the garment 10. The inserted cup supporter eliminates the need of a lining in the garment 10.

The placement of the loops 7 with the tapes 12 or the half circular loops 9 with the tapes 11 on the belt line 12 of the garment 10 is made in such a position that the adjustable straps 5 are located in the crevices formed by the lower abdomen and legs and can not be seen when the garment 10 is constructed of light weight material such as used in competition speed type swim suits which readily show the shape of a device worn under the garment 10. The cup supporter's spherical pouch provides a pleasing form that is attractive in shaping the garment 10. The garment 10 need not be restricted to swim suits, as other garments such as underwear, pants, dancing leotards and other clothing can be made for insertion of the cup supporter to provide support and protection for the male vital parts.

The ease with which the cup supporter can be transferred from one garment 10 to another garment 10 when the hook 8 and the half circular loops 9 are used, enable one cup supporter to be used in a number of garments and provides for quick removal for cleaning by washing separately. The simple construction of the inserted cup supporter makes it possible to manufacture it for little more than the cost of the lining normally used in many garments and could eliminate the need of underwear.

What I claim and desire to secure by letters patent is:

1. A supporter comprising a cup-shaped hook pouch; said hook shaped pouch comprises non-circular flexible laminate sheet foam rubber and fabric, means of sewing adjacent edges of said non-circular flexible laminate to form a partial sphere, whereby said partial sphere is defined as a sphere cut by a second imaginary sphere whose center point is some distance from said partial sphere's center point forming a compartment curved to a hook shape; an elastic secured to top edge of said compartment curved to a hook shape, said elastic has its two ends extending outwardly, said two ends thread through two buckles to form two loops from said elastic said two ends, said two loops from said eleastic are threaded through two hooks having means to accept said two loops from said elastic belt; bias tape secured to sides and bottom edges of said compartment curved to a hook shape; said two hooks accept two half circle loops attached to a garment by means of tapes, said tapes are fastened to said garment by means of sewing.

2. A supporter according to claim 1 embodying a cup-shaped hook pouch; said hook shaped pouch comprises a non-circular flexible laminate comprising sheet foam rubber and fabric, means of sewing adjacent edges of said non-circular flexible laminate to form a partial sphere, whereby said partial sphere is defined as a sphere cut by a second imaginary sphere whose center point is some distance from said partial sphere's center point forming a compartment; whereby said compartment functions to hold the male vital parts consisting of the testicles and penis.

3. A supporter according to claim 2 embodying a cup-shaped hook pouch; said hook shaped pouch comprises a non-circular flexible laminate comprising sheet foam rubber and fabric, means of sewing adjacent edges of said non-circular flexible laminate to form a partial sphere, whereby said partial sphere is defined as a sphere cut by a second imaginary sphere whose center point is some distance from said partial sphere's center point forming a compartment curved to a hook shape, whereby said compartment curved to a hook shape functions to hold the said supporter in place when the testicles are placed in said compartment curved to a hook shape.

4. A supporter according to claim 1 embodying two hooks, whereby said two hooks accept said two half circle loops attached to said garment by means of said tapes, said tapes are fastened to said garment by means of sewing, whereby said two half circle loops and said two hooks function to allow insertion and removal of said cup-shaped hook pouch to said garment.

5. A supporter according to claim 1 embodying an elastic secured to top edge of said compartment curved to a hook shape, said elastic has its two ends extending outwardly, said two ends thread through two buckles to form two loops from said elastic belts said two ends, said buckles function to adjust the length and tension of said elastic, whereby said buckles provide means for adjusting said cup-shaped hook pouch to fit any size garment.

6. A supporter comprising a cup-shaped hook pouch; said hook shaped pouch comprises non-circular flexible laminate sheet foam rubber and fabric, means of sewing adjacent edges of said non-circular flexible laminate to form a partial sphere, whereby said partial sphere is defined as a sphere cut by a second imaginary sphere whose center point is some distance from said partial sphere's center point forming a compartment curved to a hook shape; an elastic secured to top edge of said compartment curved to a hook shape, said elastic has its two ends extending outwardly, said two ends of said elastic thread through two buckles to form two loops from said elastic two ends, said two loops from said elastic are threaded through two rectangular loops, said two rectangular loops are attached to a garment by means of tapes, said tapes are fastened to said garment by means of sewing; bias tape is secured to sides and bottom edges of said compartment curved to a hook shape.

7. A supporter according to claim 6 embodying two rectangular loops, said two rectangular loops attached to said garment by means of said tapes, said tapes are fastened to said garment by means of sewing, whereby said two rectangular loops function to allow permanent insertion of said cup-shaped hook pouch to said garment.

* * * * *